United States Patent [19]

Brown

[11] Patent Number: 4,636,149

[45] Date of Patent: Jan. 13, 1987

[54] DIFFERENTIAL THERMAL EXPANSION DRIVEN PUMP

[75] Inventor: David C. Brown, Miami, Fla.

[73] Assignee: Cordis Corporation, Miami, Fla.

[21] Appl. No.: 858,823

[22] Filed: Apr. 29, 1986

Related U.S. Application Data

[63] Continuation of Ser. No. 733,414, May 13, 1985, abandoned, which is a continuation of Ser. No. 586,213, Mar. 5, 1984, abandoned.

[51] Int. Cl.[4] ..... F04B 17/00

[52] U.S. Cl. ..... 417/322; 417/413; 417/568; 60/528; 60/529

[58] Field of Search ..... 417/321, 322, 413, 568; 60/528, 529

[56] References Cited

U.S. PATENT DOCUMENTS

| | | | |
|---|---|---|---|
| 2,399,020 | 4/1946 | Hall | 137/139 |
| 2,484,405 | 10/1949 | Eskin | 158/117.1 |
| 2,867,224 | 1/1959 | Martiniak et al. | 134/58 |
| 2,884,866 | 5/1959 | Patterson . | |
| 2,989,281 | 6/1961 | Fritts | 251/11 |
| 3,014,342 | 12/1961 | Evans | 60/528 |
| 3,108,616 | 10/1963 | Ray | 137/628 |
| 3,132,472 | 5/1964 | Schweitzer | 60/23 |
| 3,152,554 | 10/1964 | Kofink . | |
| 3,184,914 | 5/1965 | Cole | 60/23 |
| 3,411,704 | 11/1968 | Hilgert et al. | 417/413 X |
| 3,606,592 | 9/1971 | Madurski et al. | 417/413 |
| 3,672,791 | 6/1972 | Zimmerly | 417/568 X |
| 4,152,098 | 5/1979 | Moody et al. | 417/413 |
| 4,204,538 | 5/1980 | Cannon | 128/214 R |
| 4,231,720 | 11/1980 | Konig | 417/379 |
| 4,265,601 | 5/1981 | Mandroian | 417/379 |
| 4,411,603 | 10/1983 | Kell | 417/479 |

FOREIGN PATENT DOCUMENTS

| | | | |
|---|---|---|---|
| 742622 | 6/1980 | U.S.S.R. | 417/321 |

*Primary Examiner*—Carlton R. Croyle
*Assistant Examiner*—Donald E. Stout
*Attorney, Agent, or Firm*—Henry W. Collins; Thomas R. Vigil

[57] ABSTRACT

The biomedical pump includes a housing with an internal pump chamber defined by a first rigid concave wall formed by the pump body, and an opposed flexible wall defined by a diaphragm incorporating a heat responsive disc for a thermal-responsive pumping movement between a first position overlying and conforming to the body defined first wall and a second position outwardly spaced therefrom. An inlet passageway and an outlet passageway each communicate with the interior of the chamber through the pump body. Each passageway incorporates a one-way check valve for a directional control of the fluid flow in response to the heat induced diaphragm movement.

20 Claims, 5 Drawing Figures

DIFFERENTIAL THERMAL EXPANSION DRIVEN PUMP

This a continuation of application Ser. No. 733,414, filed May 13, 1985, now abandoned, which is a continuation of application Ser. No. 586,213, filed Mar. 5, 1984, now abandoned.

BACKGROUND OF THE INVENTION

1. Field of the Invention

The present invention relates to a pump for use in biomedical systems, for example as a drug dispensing pump implantable within a human body. More particularly, the invention relates to such a pump utilizing a thermally responsive diaphragm as a component of the pump chamber and operable to alternately load and then completely empty the chamber, through valve controlled inlet and outlet passageways, in a regulated manner for, as an example, periodic dosing or dispensing of a medicament.

2. Description of the Prior Art

Heretofore, various pumps have been proposed wherein the pumping action is derived from a flexing diaphragm with, in many instances, the motivation for the pumping action being derived from a thermal differential. Several of these known pumps are disclosed in the following U.S. patents:

| U.S. Pat. No. | PATENTEE |
|---|---|
| 2,867,224 | Martiniak et al |
| 2,884,866 | Patterson |
| 3,152,554 | Kofink |
| 4,152,098 | Moody et al |
| 4,204,538 | Cannon |
| 4,231,720 | Konig |
| 4,265,601 | Mandroian |
| 4,411,603 | Kell |

The Martiniak et al U.S. Pat. No. 2,867,224 discloses a conditioning dispenser for use in a washing machine wherein an enlarged pumping chamber is communicated, through a check valve, with the interior of a vented liquid container. The pump chamber also communicates with a washing vat through an elongated valved outlet passageway. Movement of liquid into and out of the pumping chamber is effected by the snap flexing of a bimetallic disc selectively heated by a remote resistance heater designed to have substantial thermal output to overcome appreciable heat loss from the disc into the liquid in the large pump chamber. The disc, when heated, snaps inwardly relative to the pump chamber and dispenses a predetermined minor portion of the liquid therein. The bimetallic disc forms a minor portion of the bounding wall of the pump chamber and, in its inwardly drawn dispensing position, does not conform to the interior of the chamber, does not fully dispense the contents thereof, and does not seal against the chamber communicating ends of the inlet and outlet passageways.

The Patterson U.S. Pat. No. 2,884,866 discloses a fluid pump wherein the pumping action, through valved inlet and outlet passageways, is effected by a tubular elastic body surrounded by a thermal responsive expansible-contractible material incorporating an electric heating element for a selective heating of the material and a corresponding contraction of the cavity within the elastic body and a forcible discharge of liquid therein.

The Kofink U.S. Pat. No. 3,152,554 discloses a variety of systems wherein thermally responsive bimetallic elements effect a mechanical movement of pump diaphragms, switches and valves. In one instance, reference is made to the possibility of utilization of the bimetallic element proper as an electrical resistance conductor which is heated when current flows through it. There appears to be no indication of the bimetallic member itself constituting a material pumping diaphragm.

The Moody et al U.S. Pat. No. 4,152,098 discloses a micropump which can be implanted in a patient's body for the controlled delivery of pharmaceuticals or the like. The pump utilizes a diaphragm which is selectively flexed by the electromagnetic actuation of a plunger for selective movement of a portion of the diaphragm into and out of the pumping chamber. Movement of fluid through the inlet and outlet is controlled by a valving action utilizing the diaphragm itself which extends in overlying relation to each of the ports. The diaphragm in flexing under the influence of the separate plunger, does not conform to the wall of the pumping chamber.

The Cannon U.S. Pat. No. 4,204,538 discloses a cassette for the controlled introduction of intravenous fluid into a patient utilizing flexible diaphragms as valving means and as a means for directional control of the flow through first and second compartments defined within a chamber by a central diaphragm. The diaphragms provide no pumping action.

The Konig U.S. Pat. No. 4,231,720 discloses, in the embodiment of FIGS. 3 and 4, a membrane which, through mounted bimetallic strips, flexes between two chambers in response to temperature differential in the liquids within the chambers to effect a movement of fluid into and out of the chambers through appropriate check valves.

The Mandroian U.S. Pat. No. 4,265,601 discloses pump apparatus, for possible use in medical applications, wherein a diaphragm bifurcates the pump chamber into a first chamber volume which receives the pumped fluid and a second chamber volume containing a pumping fluid. A remote electrical heater heats the pumping fluid causing an expansion of this pumping fluid which in turn causes the diaphragm to expand against the sides of the pump chamber and thereby expel all of the pumped fluid from the first chamber volume. This system requires a separate enclosed heating chamber and the utilization of an expandable pumping fluid.

The Kell U.S. Pat. No. 4,411,603 discloses a blood pump incorporating a flexible diaphragm selectively expanded into a pumping chamber by a reciprocating plunger or piston. Flapper valves control the flow to and from the chamber.

As will be described in detail subsequently, the pump of the present invention differs from previously proposed pumps by providing a pump particularly for use within a biomedical environment and wherein the pump chamber is partially defined by a diaphragm composed of a bimetallic disc responsive to direct electrical resistance heating for a fluid pumping movement of the diaphragm resulting from a differential thermal expansion of the bimetallic components of the disc.

The diaphragm is so related to the pump chamber as to effect a full expulsion of the contents of the chamber upon a cooling of the diaphragm and a movement of the diaphragm from its thermally expanded position to its cooled at rest position. The pump chamber, in the absence of a cycling of the pump through a direct heating of the bimetallic diaphgram, is empty of fluid.

SUMMARY OF THE INVENTION

According to the invention there is provided a biomedical pump for use in the measured pumping of a medicament or the like. The pump comprises a pump body and a pump chamber in the body. The chamber is defined by a first wall formed by the pump body and an opposed second wall. An inlet passageway is provided through the body. The inlet passageway includes an inlet port in communication with the chamber through the first wall. Also provided is an outlet passageway through the body. The outlet passageway includes an outlet port in communication with the chamber through the first wall. A flow inducting diaphragm is included facing th e first wall and is selectively movable between a first position closely overlying and conforming to the first wall and sealing the ports and a selected second position which is outwardly spaced from the first wall. The side of the diaphragm faces the first wall and defines the second wall and a selected volumetric interior space within the chamber between the first and second walls. The diaphragm, in the first position, eliminates the selected volumetric interior space of the chamber. The diaphragm incorporates a heat responsive member therein and an electrical conductor member coupled to the heat responsive member and extending outwardly therefrom. The heat responsive regulated flexure of said diaphragm between the first and second positions in response to the heating and cooling of the first heat responsive member is controlled by the control of electrical energy to the heat responsive member. A support ring engages the diaphragm in a heat transfer manner and is capable of conducting heat away from the diaphragm to expedite cooling of the heat responsive member connected to the diaphragm and extending from the pump body for indicating the selected second position of the diaphragm.

DESCRIPTION OF THE PREFERRED EMBODIMENTS

Figure 1:
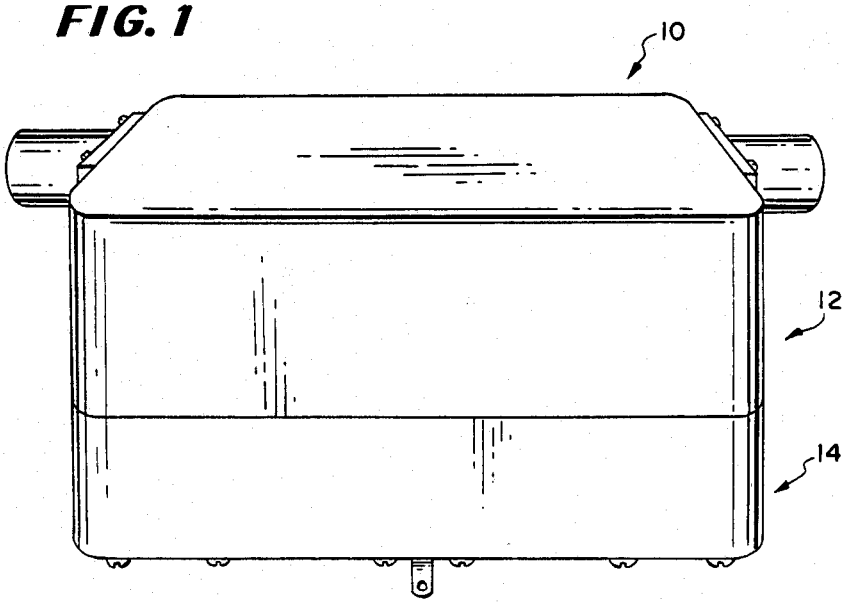
FIG. 1 is a perspective view of the assembled pump of the present invention.
Figure 2:
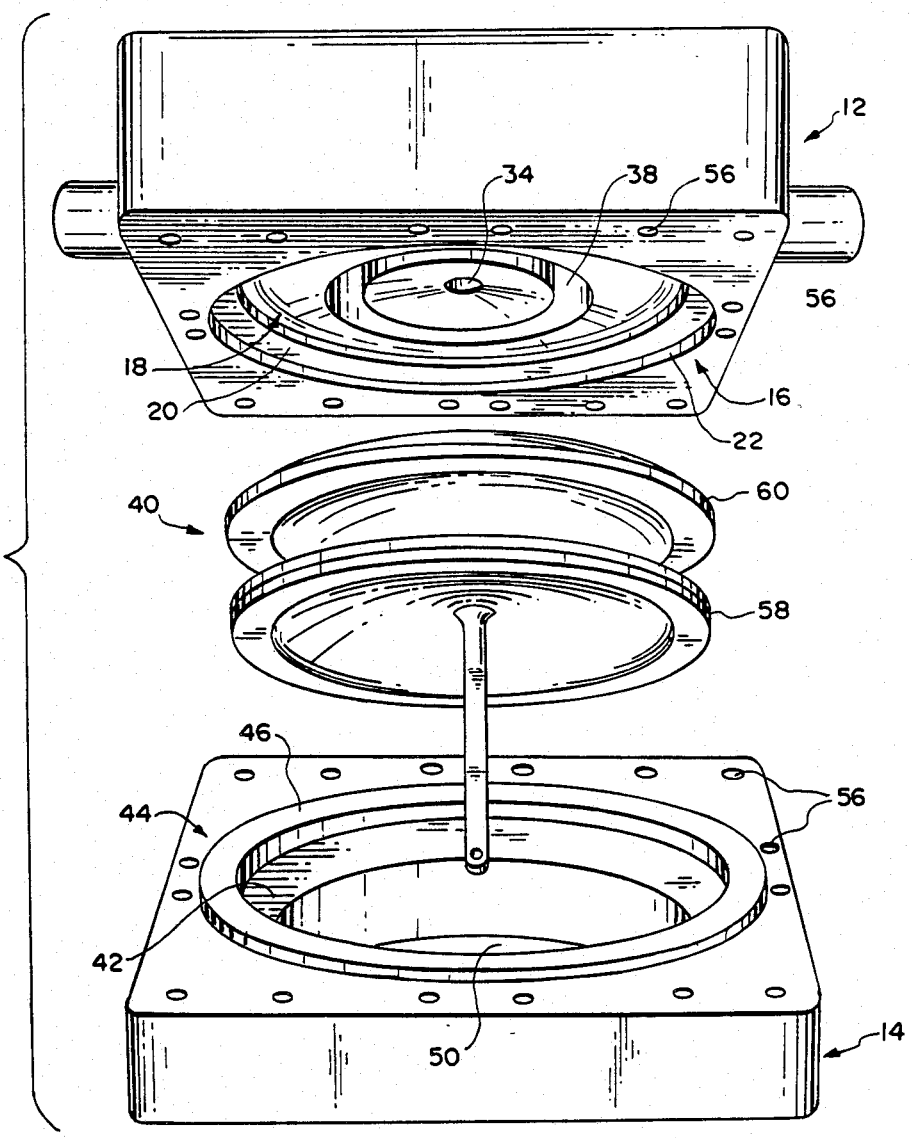
FIG. 2 is an exploded perspective view of the pump.

Referring now to the drawings in greater detail, there is illustrated therein a biomedical pump which is generally identified by the reference numeral 10. The pump 10 includes a generally rectangular housing incorporating upper and lower housing sections 12 and 14 respectively. This designation of the housing sections as upper and lower conforms to the orientation of the pump 10 in the drawings and is for purposes of illustration and description. The orientation of the pump 10 in an operational environment can vary as desired with no effect on the operation of the pump or the components thereof.

The upper housing section 12 includes a planar base or bottom face 16 having a central circular recess 18 formed therein. The inner wall 20 of recess 18, in inwardly spaced relation to the annular recess side wall 22, has a central concave depression 24 formed therein and defining a rigid wall of a pump chamber 25 (FIG. 4) which, as shall be explained in detail subsequently, sequentially receives the pumped fluid and has such fluid expelled therefrom.

Figure 3:
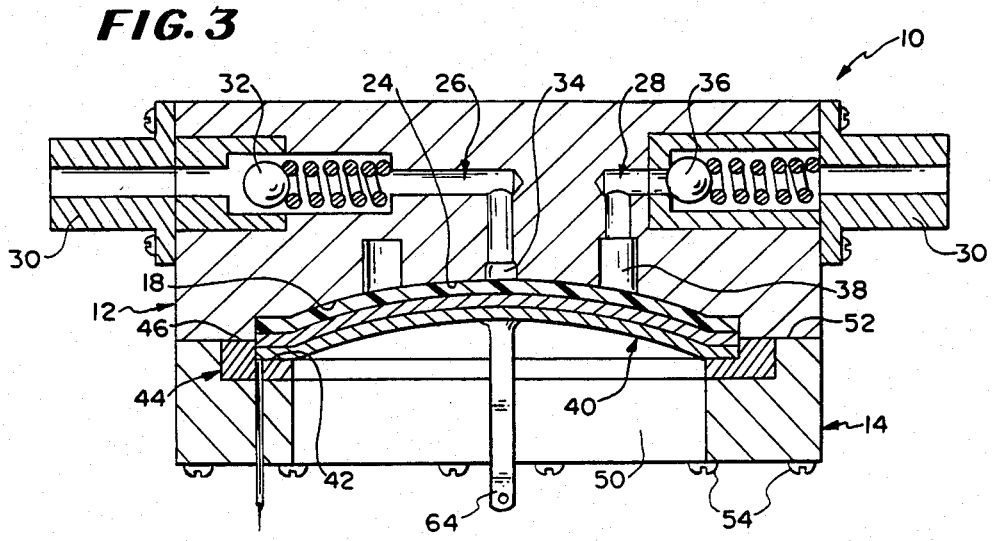
FIG. 3 is a cross-sectional view through the pump in its at rest position.

Noting FIG. 3 in particular, flow of fluid into and out of the pump chamber 25 is effected through inlet passageway 26 and outlet passageway 28, both defined through the upper housing section 12. These passageways 26 and 28 open laterally through opposed sides of housing section 12 and have, in each instance, a flanged tubular adapter 30 bolted to the housing section or in alignment therewith for the accommodation of external fluid conduits, tubing, or the like.

Inlet passageway 26 includes, adjacent the outer end thereof, a spring loaded ball check valve 32 which, in a typical manner, allows ingress of fluid while precluding egress therethrough. The inner end of the inlet passageway 26 terminates in an inlet port 34 opening into the pump chamber 25 centrally of the chamber wall 24 at the apex thereof.

The outlet passageway 28 is provided with a one-way ball check valve 36 positioned toward the outer end thereof and oriented for operation, in an obvious manner, to selectively allow egress of the pumped fluid, during the discharge of the pump chamber, and preclude ingress. The inner end of the outlet or discharge passageway 28 opens inward into the pump chamber through an annular port 38, in the nature of an annulus or annular recess, positioned in outwardly surrounding relation to the inlet passageway port 34 and generally between the circumference of the domed chamber wall 24 and the apex thereof. The outlet passageway 28, inward of the annular port 38, is a linear passageway directly communicating with the annular port 38 at one point thereabout.

The pump chamber 25 is completed by the flexible diaphragm 40 which, in its normal unstressed configuration, as illustrated in FIG. 3, includes a central inwardly domed portion conforming to and intimately engaging against the housing formed wall 24, completely sealing the inlet and outlet ports 34 and 38 and maintaining the volumetric capacity of the pump chamber at substantially zero. The peripheral portion of the diaphragm 40, immediately outward of the domed central portion thereof, is planar and lies intimately against the inner and side walls 20 and 22 of the recess 18 in the bottom surface of the upper housing section 12.

The planar peripheral portion of the diaphragm 40 extends below the upper housing section recess 18 and is received within an annular upwardly and inwardly directed seat 42 formed in the upper inner edge portion of a ring or annular member 44 of otherwise rectangular cross-sectional configuration. The upper edge 46 of the ring 44, outward of the seat 42, is planar and engages flush against the undersurface 16 of the upper housing section 12 for a positive confinement of the peripheral edge portions of the diaphragm 40.

The ring 44 is in turn received within an upwardly and inwardly directed seat 48 in the lower housing section 14 which is in the nature of a rectangular collar having a central circuit opening 50 therethrough. The opening 50 generally diametrically and circumferentially conforms to the domed central portion of the diaphragm 40. This lower housing section 14 includes a planar upper surface 52 coextensive with the upper surface 46 of the ring 44 and similarly in intimate engagement with the planar undersurface 16 of the upper housing section 12. The housing sections 12 and 14 are rigidly interconnected, to define the pump body, by appropriate fastener means, for example bolts 54 introduced upwardly through the lower housing section 14 through aligned bolt receiving bores 56 in the respective housing sections. The bores, as needed, will be internally threaded for effecting the desired interlocking.

Figure 4:
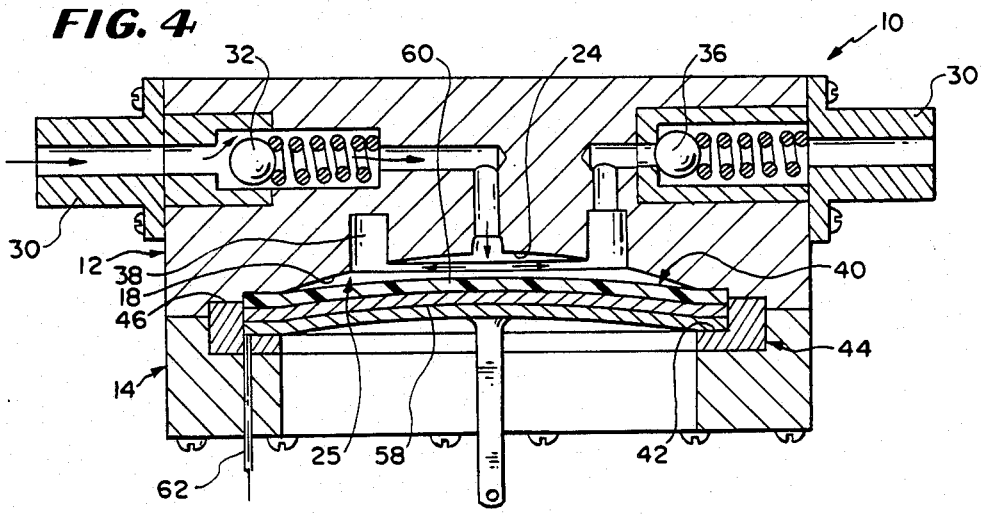
FIG. 4 is a cross-sectional view through the pump illustrating the components thereof during the intake of fluid resulting from the thermal expansion of the diaphragm.

Referring now more specifically to the diaphragm 40, the diaphragm is composed of a bimetallic disc 58 consisting of two or more layers of rigid material with different coefficients of thermal expansion so oriented whereby when heated, the bimetallic disc 58, and hence the diaphragm 40, will move from the normal or at rest position of FIG. 3 outward relative to the interior of the chamber 25, as in FIG. 4, to effect an increase in the volumetric capacity of the pump chamber 25. A subsequent cooling of the bimetallic disc 58 results in a return of the disc 58 and diaphragm 40 to the chamber emptying position as noted in FIG. 5.

The diaphragm 40 is completed by a gasket 60 overlying and coextensive with the bimetallic disc 58. This gasket 60, made of an appropriate material non-reactive to the fluid to be pumped, is capable of both sealing the interior of the pump chamber 25 and effectively both electrically and thermally insulating the interior of the chamber 25 from the bimetallic disc 58.

The actual flexing of the diaphragm 40, and the resultant pumping of the fluid, is effected by a sequential heating and cooling of the bimetallic disc 58 by means of the introduction of an electrical current directly thereto, through appropriate conductor means 62, for an electrical resistance heating of the bimetallic layers. Alternatively, a separate resistance heating element may be incorporated into the diaphragm 40 rather than relying solely on the resistance developed within the bimetallic disc 58 itself. Another possibility involves the use of a heat absorbing layer added to the diaphragm 40 which is used in conjunction with an external energy source of radiant heat. As noted in the drawings, a depending element 64 may be affixed centrally to the diaphragm 40 to provide a means through which the position of the diaphragm 40 can be signalled for feedback means, control of the input of external energy, or the like.

The diaphragm seating annular member or ring 44, in the nature of a heat sink, provides a thermal conduction path for a rapid removal of heat from the diaphragm 40 upon removal or discontinuation of the external energy source, such as the electric current. This decrease in temperature in turn provides for a movement of the flexed diaphragm 40 from its intake position of FIG. 4 to its chamber exhausting position of FIG. 5.

FIG. 3 illustrates the normal or at rest position of the diaphragm 40 with the volumetric capacity of the pump chamber 25 substantially at zero avoiding, during periods of nonuse, any residence of fluid within the chamber 25. In this position, both ball check valves 32 and 36 are seated and an additional sealing of the inlet and outlet passageways 26 and 28 is effected by a sealing engagement of the gasket 60 with the respective ports 34 and 38.

Figure 5:
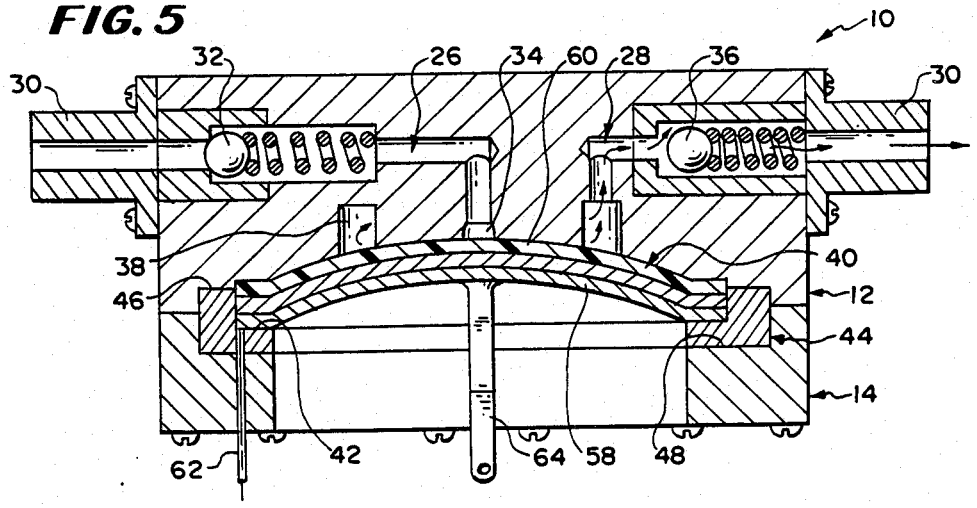
FIG. 5 is a cross-sectional view similar to FIG. 4 illustrating the components of the pump as the thermally cooled diaphragm fully seats and effects a complete exhausting of the chamber.

In operation, noting FIGS. 4 and 5, the introduction of an electrical current to the bimetallic diaphragm disc 58, or a separate resistance heating element incorporated therein, effects an outward flexing of the diaphragm 40 away from the rigid chamber wall 24, an increase in the volumetric capacity of the chamber 25, and an inflow of fluid through the inlet passageway 26 past the check valve 32. The outlet passageway 28 is maintained closed by the seated associated ball valve 36. Upon a completion of the fluid intake stroke of the diaphragm, the heating of the diaphragm is terminated with the diaphragm rapidly cooling, utilizing the heat sink capability of the ring 44, and the diaphragm 40, through the inherent resiliency thereof, moving against the inner concave wall 24 to completely exhaust the contents of the chamber as illustrated in FIG. 5. The provision of an annular outlet port 38 is considered significant in insuring a complete evacuation of the chamber 25 with minimal disruption of the fluid and without any possibility of fluid residing within the chamber 25 between cycles which, in itself, could have an adverse effect on the fluid depending upon the particular nature thereof.

The particular construction and manner of operation of the pump 10, as described, incorporate numerous advantages. For example, in light of the direct integration of the energy input into the diaphragm 40 itself, the heating rate can be adjusted as desired. Thus, it is possible to utilize a very low power energy source to avoid any adverse effects on the fluid as might arise from a rapid heating thereof, notwithstanding the insulating gasket interposed between the interior of the chamber and the bimetallic disc. Also, the pump 10 is essentially without energy loss in that the electrical resistance heating is converted directly into useful work.

It will be recognized that the forces developed are fundamentally limited only by the compressive and tensile strengths of the materials used, the pump 10 being capable of accommodating very high pressures. In conjunction therewith, there are no inherent limits on the pump size or the pump cycle rate. No lubrications are required for operation of the pump 10 nor is there any requirement for precise dimensional control of the pump components. The pump diaphragm 40 itself forms a highly effective seal for the inlet and outlet passageways 26 and 28 in addition to the sealing action of the check valves. This diaphragm 40, as desired, may be provided with a "snap action". Similarly, through a slight modification in the design of the housing, and in particular the lower housing section, travel of the diaphragm 40 to the chamber expanding position can be limited for an accurate positive displacement.

Numerous other advantages inherent in the invention as described may be appreciated. Accordingly, the scope of the invention is only to be limited as necessitated by the accompanying claims.

I claim:

1. A biomedical pump for use in the measured pumping of a medicament or the like, said pump comprising: a pump body; a pump chamber in said body, said chamber being defined by a first wall formed by said body and an opposed second wall; an inlet passageway through said body, said inlet passageway including an inlet port in communication with said chamber through said first wall; an outlet passageway through said body, said outlet passageway including an outlet port in communication with said chamber through said first wall; a flow inducing diaphragm including a bimetallic member, facing said first wall, and being selectively movable between a first position closely overlying and conforming to said first wall and sealing said ports and a selected second position which is outwardly spaced from said first wall, the side of said diaphragm facing said first wall defining said second wall and defining a selected volumetric interior space within said chamber between said first and second walls; said diaphragm, in said first position, eliminating the selected volumetric interior space of said chamber; said diaphragm bimetallic member being heat responsive for effecting regulated flexure of said diaphragm between said first and second positions in response to heating and cooling of said heat responsive bimetallic member to effect precise pumping of a selected volume of fluid defined by said selected volumetric interior space of said chamber, electrical conductor means coupled to said bimetallic member and extending outwardly therefrom; said bimetallic member being selectively flexible by the control of the input of electrical energy thereto; a support ring engaging said bimetallic member in a heat transfer manner and being capable of conducting heat away from said bimetallic member to expedite cooling of said bimetallic member; and, means connected to said diaphragm and extending out of said pump body for indicating the selected second position of said diaphragm.

2. The pump of claim 1 wherein said bimetallic member is a disc, and said diaphragm also comprises an insulating gasket overlying said bimetallic disc inward thereof relative to said pump chamber.

3. The pump of claim 2 wherein the first wall of said pump chamber is concave with a central apex area, said inlet port opening through said apex area, said outlet port being annular and surrounding said inlet port in outwardly spaced relation thereto.

4. The pump of claim 3 wherein said bimetallic disc comprises a resistance heating element.

5. The pump of claim 1including a one-way valve mounted in each of said inlet and outlet passageways.

6. The pump of claim 1 wherein the first wall of said pump chamber is concave with a central apex area, said inlet port opening through said apex area, said outlet port being annular and surrounding said inlet port in outwardly spaced relation thereto.

7. The pump of claim 1 wherein said indicating means comprise a rod-like element affixed to and extending from the side of said diaphragm facing away from said first wall.

8. The pump of claim 7 wherein the extent said rod-like element extends from said pump body can be used to indicate the selected volumetric interior space within said chamber.

9. A biomedical pump for use in the measured pumping of a medicament or the like, said pump comprising: a pump body; a pump chamber in said body, said chamber being defined by a first wall formed by said pump body and an opposed second wall; an inlet passageway through said body; said inlet passageway including an inlet port in communication with said chamber through said first wall; an outlet passageway through said body, said outlet passageway including an outlet port in communication with said chamber through said first wall; a flow inducing diaphragm facing said first wall and being selectively movable between a first position closely overlying and conforming to said first wall and sealing said ports and a selected second position which is outwardly spaced from said first wall, the side of said diaphragm facing said first wall defining said second wall and defining a selected volumetric interior space within said chamber between said first and second walls; said diaphragm, in said first position, eliminating the selected volumetric interior space of said chamber; said diaphragm incorporating heat responsive means therein; electrical conductor means coupled to said heat responsive means and extending outwardly therefrom; regulated flexure of said diaphragm between said first and second Positions in response to the heating and cooling of said heat responsive means being controlled by the control of electrical energy to said heat responsive means; a support ring engaging said diaphragm in a heat transfer manner and being capable of conducting heat away from said diaphragm to expedite cooling of said heat responsive means; and, means connected to said diaphragm and extending from said pump body for indicating the selected second position of said diaphragm.

10. The pump of claim 9 wherein said heat responsive means is a bimetallic disc, and said diaphragm also comprises an insulating gasket overlying said bimetallic disc inward thereof relative to said pump chamber.

11. The pump of claim 9 wherein the first wall of said pump chamber is concave with a central apex area, said inlet port opening through said apex area, said outlet port being annular and surrounding said inlet port in outwardly spaced relation thereto.

12. The pump of claim 10 wherein said bimetallic disc comprises a resistance heating element.

13. The pump of claim 9 including a one-way valve mounted in each of said inlet and outlet passageways.

14. The pump of claim 9 wherein said first wall of said pump chamber is concave with a central apex area, said inlet port opening through said apex area, said outlet port being annular and surrounding said inlet port in outwardly spaced relation thereto.

15. The pump of claim 9 wherein said indicating means comprise a rod-like element affixed to and extending from the side of said diaphragm facing away from said first wall.

16. The pump of claim 15 wherein the extent said rod-like element extends from said pump body can be used to indicate the selected volumetric interior space within said chamber.

17. A biomedical pump for use in the measured pumping of a medicament or the like, said pump comprising: a pump body; a pump chamber in said body, said chamber being defined by a first concave wall within a central apex formed by said body and an opposed second wall; an inlet passageway through said body, said inlet passageway including an inlet port in communication with said chamber through said apex area of said first wall; an outlet passageway through said body, said outlet passageway including an annular outlet port in communication with said chamber through said first wall and surrounding said inlet port in outwardly spaced relation thereto; a flow inducing diaphragm comprising a bimetallic member including a resistance heating element and an insulating gasket overlying said bimetallic member, said member having electrical conductor means coupled thereto and extending outwardly therefrom, said diaphragm facing said first wall and being selectively movable between a first position closely overlying and confirming to said first wall and said sealing ports, and a selected position which is outwardly spaced from said first wall, the side of said diaphragm facing said first wall defining said second wall and defining a selected volumetric interior space within said chamber between said first and second walls; said diaphragm, in said first position, eliminating the selected volumetric interior space of said chamber, said bimetallic member being selectively heat responsive by the control of electrical energy thereto for effecting regulated flexure of said diaphragm between said first and second positions in response to heating and cooling of said heat responsive bimetallic member to effect precise pumping of a selected volume of fluid defined by the selected volumetric interior space of said chamber; and a support ring engaging said bimetallic member in a heat transfer manner and being capable of conducting heat away from said bimetallic member to expedite cooling of said bimetallic member.

18. The pump of claim 17 including a one-way valve mounted in each of said inlet and outlet passageways.

19. The pump of claim 17 including a signalling element fixed to said bimetallic member and projecting outwardly therefrom.

20. The pump of claim 19 wherein said signalling element comprises a rod-like element affixed to and extending from the side of said diaphragm facing away from said first wall and the extent of said rod-like element extends from said pump body indicating the selected volumetric interior space within said chamber.

* * * * *